US007037409B1

(12) United States Patent
Hippe et al.

(10) Patent No.: US 7,037,409 B1
(45) Date of Patent: May 2, 2006

(54) METHOD OF HOT-REPAIRING THE HEATING FLUES OF A COKE-OVEN BATTERY AND DEVICE FOR CARRYING OUT SAID METHOD

(75) Inventors: Werner Hippe, Gladbeck (DE); Hans-Juergen Fischer, Essen (DE)

(73) Assignee: Thyssen Krupp Encoke GmbH, Bochum (DE)

( * ) Notice: Subject to any disclaimer, the term of this patent is extended or adjusted under 35 U.S.C. 154(b) by 0 days.

(21) Appl. No.: 09/914,326

(22) PCT Filed: Mar. 8, 2000

(86) PCT No.: PCT/EP00/01998

§ 371 (c)(1),
(2), (4) Date: Jan. 14, 2002

(87) PCT Pub. No.: WO00/53694

PCT Pub. Date: Sep. 14, 2000

(30) Foreign Application Priority Data

Mar. 9, 1999 (DE) ..... 199 10 300

(51) Int. Cl.
*C10B 17/00* (2006.01)
*C10B 47/00* (2006.01)

(52) U.S. Cl. ..... 201/10; 201/13; 201/14; 201/26; 201/36; 201/41; 201/43; 432/29; 432/30; 432/177; 432/3; 432/4; 432/178; 202/144; 202/270

(58) Field of Classification Search ..... 201/10, 201/13, 14, 26, 36, 41, 43; 432/29, 30, 177, 432/3, 4, 178; 202/144, 270
See application file for complete search history.

(56) References Cited

U.S. PATENT DOCUMENTS

| | | | | |
|---|---|---|---|---|
| 4,111,756 A | | 9/1978 | Lagemann | |
| 4,268,360 A | | 5/1981 | Tsuzuki | |
| 5,092,765 A | * | 3/1992 | Wahlfeld | 432/3 |

FOREIGN PATENT DOCUMENTS

EP 0 421 147 A 4/1991

* cited by examiner

*Primary Examiner*—Glenn Caldarola
*Assistant Examiner*—Alexis Wachtel
(74) *Attorney, Agent, or Firm*—Fay, Sharpe, Fagan, Minnich & McKee, LLP

(57) ABSTRACT

A method and a device for the hot-repairing of the heating flues of a coke-oven battery according to which the completed sections of a heating flue still under construction are heated by means of a heated gas. The heated gas comprises the air usually provided for combustion in the heating flues during coking operations. The air is guided through the flow paths provided for in the coke-oven battery for combustion air and waste gases as well as through the regenerator, heated as it passes through the flow paths and then guided through the heating flues to be repaired. The completed section of the heating flue is separated from the non-completed portion by an air-reversion device that also directs the heated air.

22 Claims, 3 Drawing Sheets

METHOD OF HOT-REPAIRING THE HEATING FLUES OF A COKE-OVEN BATTERY AND DEVICE FOR CARRYING OUT SAID METHOD

The invention pertains to a method and a device for hot repair of heating flues of a coke-oven battery with which, even during the construction of the heating flues, the already completed sections of the heating flues are heated by means of heated gas.

BACKGROUND OF THE INVENTION

It is known from EP 0 421 174 131 that even during the construction of the heating flues, the already completed sections of each heating flue are heated to a temperature of approximately 250° C. by means of heated air. The air is injected through a heating tube (calorifier) by means of a compressor into the heating flues and the air exits the flues through a chimney at the upper completed end. The heating of the air required by the this method is done through indirect heat exchange with the hot parts of the coke-oven battery. The heating tube is installed either above the regenerator grating in the regenerator of the coke oven or on the oven bottom.

This method is associated with high installation expense for tube and pipeline material. In addition, an air compressor must be installed in order to force the air through the tube paths and the heating flues. The technical effort according to the method for heating the newly constructed heating flues is very high in comparison with the short heating time required.

The problem of the invention is based on improving the heating of the heating flues to the effect that satisfactory heating properties are achieved with simpler technology.

SUMMARY OF THE INVENTION

The problems are solved by utilizing an air reversing device according to the present invention. The air reversing device separates the completed section of the heating flue from the non-completed portion of the heating flue and which directs the heating gas. In addition, an air reversing device according to the present invention can be moved incrementally upwardly with the progress of the work on the heating flue. Furthermore, the air reversing device can include a sliding valve for regulating the flow of combustion air through the flues and the device. And even further, an air reversing device according to the present invention can include a temperature monitor which monitors the temperature at at least one temperature measurement point. Yet even further, an air reversing according to the present invention can include multiple inlets and multiple outlets such that the completed portion of more than two heating flues can be heated by the air reversing device. Furthermore, the flow of heated gasses can be reversed without modification to the air reversing device to further balance the temperatures in the completed portion.

According to the invention, during the construction of the heating flues, the already completed sections of each heating flue are heated to a temperature of, e.g., approximately 250° C., by means of completely normal combustion air that is preheated by the regenerator of the coke oven, wherein the flow paths in the coke-oven battery for combustion air and exhaust gas are used by the regenerator. The air reversing device according to the present invention, that follows the construction progress, is installed in the flow path for ovens with twin heating flues. The air reversing device comprises, first, known cover plates that restrict the falling down of mortar, dirt, or anything else into the heating flue during construction, and second, at least one air passage tube that circumvents the frame wall between at least two heating flues, that penetrates the cover plates in the region of its open ends, and that fluidly connects at least two heating flues. The air reversing device can further include a slide valve installed for regulating the throughput of the combustion air.

During construction, the already constructed parts of the heating flues are supplied with preheated air by the regenerator of the coke oven. This air is pushed upwards through the already constructed heating flue part and then pushed downwards through the heating flue part and back towards the regenerator via the air reversing device. From the regenerator, the air is pushed into the chimney by means of the exhaust gas channel and then ejected into the atmosphere.

The combustion gas supply to the heating flues being repaired remains uninterrupted, so that over the flow path of the heating media (air and gas) of a heating flue, merely the combustion gas flows through the regenerator, a certain amount of heat is received, and this heat is dissipated again at the newly erected heating flues to be heated. The combustion air is used as a heat carrier medium. In this way, a simple and energy-efficient heating of the newly constructed wall is achieved.

The air reversing device is set incrementally higher with the progress of the work on the wall, so that the newly constructed parts of the heating flue are correspondingly heated. In this respect, the air reversing device is designed so that 4–6 sections (layers of bricks) can be worked on at one time.

The regulation of the combustion air flow rate is done with the regulation element that is already provided on the coke oven. Precise regulation of the combustion air flow rate and thus the temperature in the already completed sections of the heating flues to be repaired is done, e.g., by means of a slide valve in the air reversing device. The temperature is controlled by temperature measurement points that are arranged, in particular, below of the air reversing device.

The cost for heating the heating flues is reduced by this simple method. That is, repair according to this method is considerably more cost effective.

The aforementioned steps of the method and components, as well as those claimed and described in the embodiment, and which are to be used according to the invention, have no special requirements relative to the method, size, shape, material selection, and technical design, so that the known selection criteria in each field of application can be used without restriction.

Additional details, features, advantages and objects of the invention will become apparent to those skilled in the art upon reading and understanding the following detailed description of the preferred embodiments.

BRIEF DESCRIPTION OF THE DRAWINGS

Reference may now be had to the drawings, which illustrates various embodiments that the invention may take in physical form and in certain parts and arrangements of parts wherein.

DESCRIPTION OF THE PREFERRED EMBODIMENTS

Figure 1:
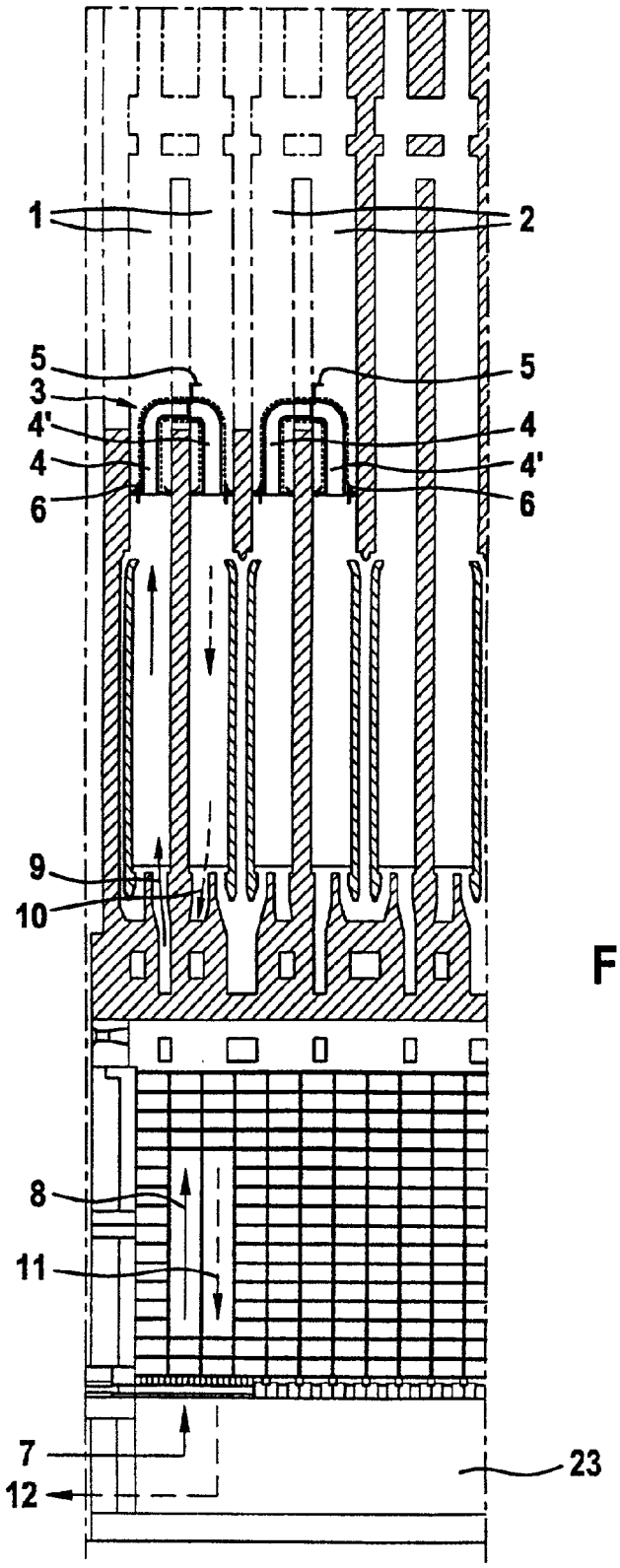
FIG. 1 is a vertical section, in schematic representation, through several twin heating flue pairs, in which two air reversing devices according to the present invention are arranged.

Referring now to the drawings wherein the showings are for the purpose of illustrating preferred embodiments of the invention only and not for the purpose of limiting the same, FIG. 1 shows a section through two heating flue pairs 1 and 2 to be repaired. Corresponding air reversing devices 3, with air passage tubes 4 and 4', rearranged in heating flue pairs 1 and 2. The air passage tubes 4 and 4' are connected in a gas-tight manner at their lower ends to cover plates 17, 17' that separate the constructed part of the heating flues 1 and 2 from the part still to be constructed. The air passage tubes 4' are each provided with a slide valve 5, with which the amount of air can be regulated for adjusting the desired temperature of approximately 250° C. below the air reversing device 3. The temperature below the air reversing device is measured with thermo elements 6.

The flow path of the combustion air is shown by arrows. According to the arrow 7 (FIGS. 1 and 2), the combustion air flows into the regenerator bottom channel 23, flows through the regenerator 8, and enters at the combustion level 9 into the heating flue pair 1 to be repaired. The combustion air then flows through the air reversing tubes 4 and 4' and downwards through the heating flue 1, via the combustion level 10 and into a neighbouring regenerator 11, and there it exits according to the arrow 12 to the chimney through the regenerator bottom channel 23.

The flow rate of the combustion air is determined by the chimney draft, as well as by the adjustment of the regulating valves of the coke oven, which are not shown in FIG. 1. Additional regulation of the combustion air throughput is carried out with the slide valve 5 of the air reversing device 3.

Figure 2:
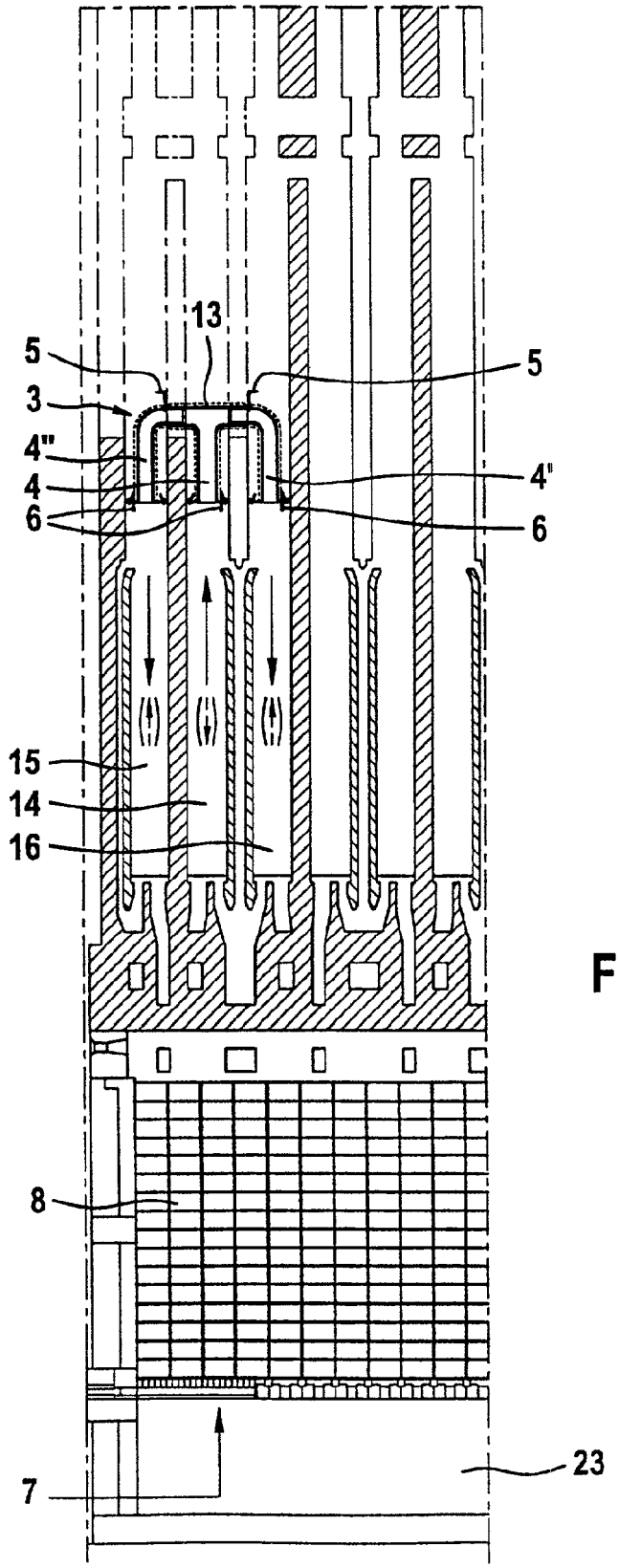
FIG. 2 is a vertical section, in schematic representation, through several heating flue pairs, in which a second configuration of the air reversing device is arranged, which can heat three heating flues.

FIG. 2 shows a perpendicular section through three newly constructed heating flues 14, 15, and 16. In this case, the air reversing device 3 comprises more parts. The air passage tubes 4, 4', and 4" are inserted into an intermediate part 13. In this case, the air passage tubes 4" and 4' are each provided with a slide valve 5. The remaining reference numbers have the same meaning as in FIG. 1. The combustion air flows through the middle heating flue 14 upwards through the air reversing device 3, is distributed downwards through the heating flues 15 and 16, and again flows over the regenerator 8 to the corresponding exhaust gas valves in the coke oven. After the reversal of the regenerator, the combustion air flows in the heating flues 15 and 16 upwards according to the arrows within the parentheses, is drawn by suction by the heating flue 14, and flows through the regenerator 8 to the corresponding exhaust gas valve of the coke oven.

Figure 3A:
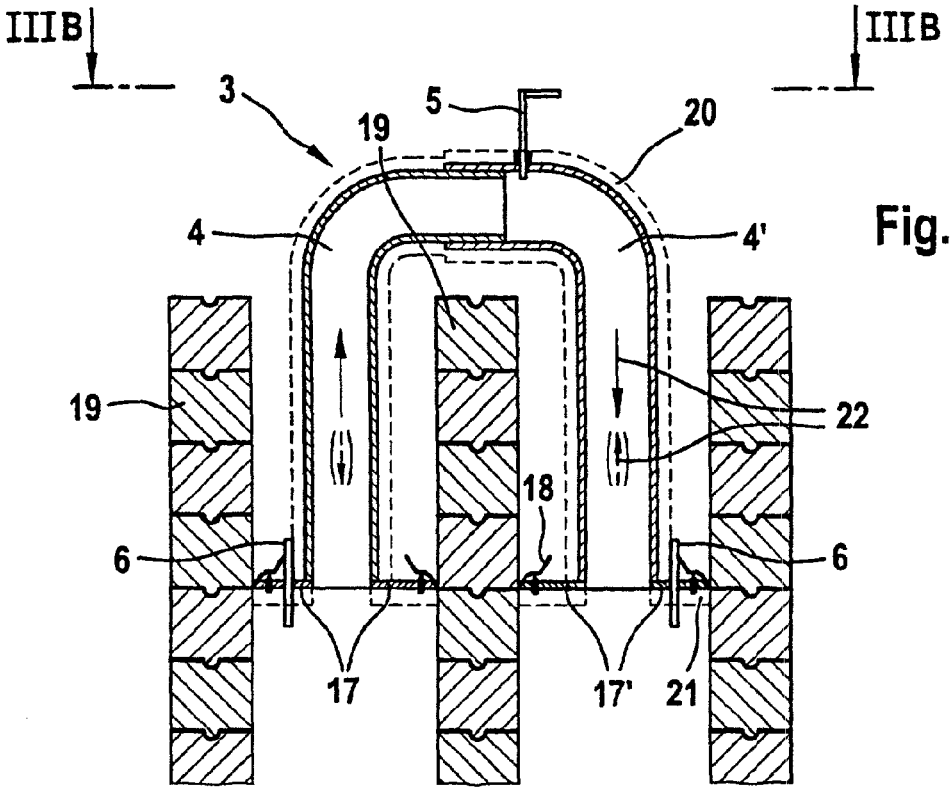
FIG. 3A is a cross-sectional enlargement taken along line IIIA—IIIA in FIG. 3B of the air reversing device shown in FIG. 1.
Figure 3B:
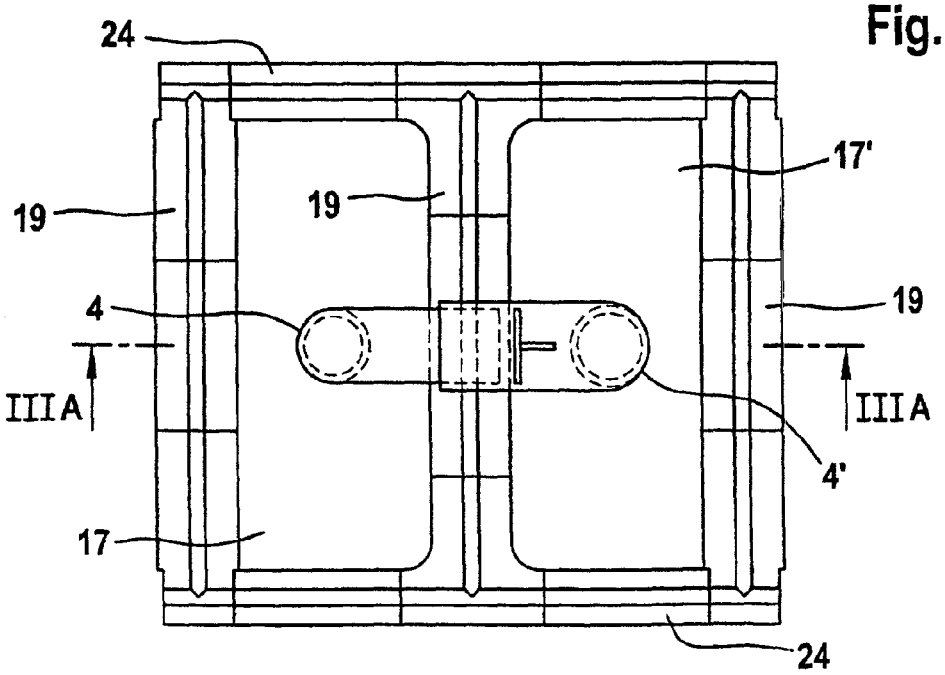
FIG. 3B is a view taken along line IIIB—IIIB in FIG. 3A of the air reversing device shown in FIG. 1.

The exact arrangement of the air reversing device 3 in the heating flues that are to be repaired and that comprise the frame walls 19 and the sliding walls 24 can be seen in FIGS. 3A and 3B. The air reversing device comprises the air passage tubes 4 and 4' that are connected in a gas-tight manner to the cover plates 17, 17', where the air passage tubes 4 and 4' are set together with their horizontal ends and locked at each joint of the heating flue walls with the help of at least one locking mechanism 18 that is arranged on the cover plate 17,17'. Thus, during further construction, the air reversing device 3 can be moved quickly. The air passage tubes 4 and 4' are designed such that 4–6 sections of the frame walls 19 and the sliding walls 24 can be worked on at one time.

For protection of the walls against heat and for better insulation of the air reversing device 3, the air reversing device is covered with, e.g., fibrous insulation 20. The cover plates 17 should also be lined with fibrous insulation 21 on their bottom side. In this way, also the seal to the frame walls 19 and the sliding walls (24) is improved. The flow of the air through reversing device 3 is shown by the arrows 22, and the direction changes according to the heating reversal of the coke-oven battery and the corresponding reversal period after approximately 20 min.

LIST OF REFERENCE NUMBERS

1 Heating flue pair
2 Heating flue pair
3 Air reversing device
4 Air passage tube
4' Air passage tube
4" Air passage tube
5 Sliding valves
6 Thermo element
7 Arrow
8 Regenerator
9 Combustion level
10 Combustion level
11 Neighbouring regenerator
12 Arrow
13 Intermediate part
14 Heating flue
15 Heating flue
16 Heating flue
17 Cover plate
18 Locking mechanism
19 Frame wall
20 Insulation
21 Insulation
22 Arrow
23 Regenerator bottom channel
24 Sliding wall Therefore it is claimed:

1. A method of maintaining a desired temperature in an already completed section of a heating flue in a coke-oven battery during the construction or repair of a non-completed portion of heating flue, said method comprising the steps of:

providing a heated gas, the heated gas being air that is normally present in the heating flues;

guiding the gas through flow paths present in the coke-oven battery for the combustion air and the exhaust gas;

directing the guided gas through the desired heating flue to be repaired; and providing an air reversing device which separates the completed section of the heating flue from the non-completed portion.

2. The method according to claim 1, further comprising the step of moving the position of the air reversing device incrementally upwards with the progress of the work on the heating flue.

3. The method according to claim 2, further comprising the step of regulating the combustion air throughput by the air reversing device.

4. The method according to claim 3, wherein the regulating of the combustion air throughput is done by a sliding valve.

5. The method according to claim 4, further comprising the step of controlling the temperature in the completed section by at least one temperature measurement point.

6. The method according to claim 1, further comprising the step of regulating the combustion air throughput by the air reversing device.

7. The method according to claim 6, wherein the regulating of the combustion air throughput is done by a sliding valve.

8. The method according to claim 1, further comprising the step of controlling the temperature in the completed section at a temperature measurement point.

9. The method according to claim 1, further comprising the step of reversing the direction of the heated gas.

10. The method according to claim 9, wherein the reversal is done approximately every 20 minutes.

11. An air reversing device for maintaining a desired temperature in an already completed section of a heating flue in a coke-oven battery during the construction or repair of a non-completed section of the heating flue above the completed section, said reversing device comprising: at least one air passage tube and a cover plate, said cover plate being configured to separate the completed section from the non-completed section, said at least one air passage directing heating gases from the completed section of one heating flue to another heating flue.

12. The air reversing device according to claim 11, further comprising a sliding valve for regulating the amount of the heating gases.

13. The air reversing device according to claim 12, further comprising at least one temperature measurement point for controlling the desired temperature in the region of the air reversing device.

14. The air reversing device according to claim 11, further comprising at least one temperature measurement point for controlling the desired temperature in the region of the air reversing device.

15. An air reversing device for maintaining a desired temperature in an already completed section of a heating flue in a coke-oven battery during the construction or repair of a non-completed section of the heating flue above the completed section, the already completed section having a plurality of flues, said reversing device comprising: an air passage tube having an inlet in fluid communication with a first flue of the plurality of flues and an outlet in fluid communication with a second flue of the plurality of flues, and a cover plate which along with said tube separates the completed section from the non-completed section, said passage tube directing the heating gases from the first flue to the second flue.

16. The air reversing device according to claim 15, wherein said outlet is a first outlet and said passage tube further includes a second outlet in fluid communication with a third flue, said inlet directing the heating gases to both said first and said second outlets.

17. The air reversing device according to claim 15, wherein said inlet is a first inlet and said passage tube further includes a second inlet in fluid communication with a third flue, said first and second inlets directing the heating gases to said outlet.

18. The air reversing device according to claim 17, wherein said outlet is at least two outlets.

19. A method for hot repair of coke oven battery heating flues operated in pairs or groups, wherein heating of the finished sections of the respective heating flue already takes place by heated gas during the bricking up of the heating flues, the air usually provided in heating flues for combustion during coking operation being used as heated gas, said air being passed through the flow paths provided in the coke oven battery for the air for combustion and the exhaust gas, and also through the regenerator, and in so doing is heated up and is then passed through the heating flues for repair, the completed bricked part of the heating flue being separated by an air reversal device from that part of the heating flue which is still to be bricked up.

20. A method according to claim 19, wherein regulation of the flowthrough of air for combustion takes place in the air reversal device.

21. A method according to claim 20, wherein regulation of the flowthrough of air for combustion is effected by a slide valve.

22. A method according to any one of claims 19, wherein control of the temperature in the region of the air reversal device is affected by at least one temperature measuring station.

* * * * *